US005733140A

United States Patent [19]

Baker, III et al.

[11] Patent Number: 5,733,140

[45] Date of Patent: Mar. 31, 1998

[54] CONNECTING BLOCK AND PATCH CORD COMBINATION

[75] Inventors: Frank Phillips Baker, III, Chatham; Golam Mabud Choudhury, Township of Warren, Somerset County; Theodore Alan Conorich, Parsippany Township, Morris County, all of N.J.; Leonard Hugh Drexler, Carmel, Ind.; Michael Gregory German, Secaucus, N.J.; Jeffrey Dale Nielson, Omaha, Nebr.

[73] Assignee: Lucent Technologies Inc., Murray Hill, N.J.

[21] Appl. No.: 614,031

[22] Filed: Mar. 12, 1996

[51] Int. Cl.[6] ..... H01R 4/24; H01R 4/26; H01R 11/20

[52] U.S. Cl. ..... 439/404; 439/922; 439/358

[58] Field of Search ..... 439/49, 357, 358, 439/404, 709, 719, 922, 942

[56] References Cited

U.S. PATENT DOCUMENTS

| | | | |
|---|---|---|---|
| 3,605,070 | 9/1971 | Krafthefer | 439/357 |
| 3,611,264 | 10/1971 | Ellis, Jr. | 439/404 |
| 3,702,456 | 11/1972 | Patton | 439/719 |
| 3,945,706 | 3/1976 | Steiner et al. | 439/922 |
| 5,332,397 | 7/1994 | Ingalsbe | 439/76.1 |

FOREIGN PATENT DOCUMENTS

| | | | |
|---|---|---|---|
| 9208255 | 5/1992 | European Pat. Off. | 439/404 |
| 1500722 | 2/1978 | United Kingdom | 439/357 |

*Primary Examiner*—Neil Abrams
*Assistant Examiner*—Katrina Davis

[57] ABSTRACT

Disclosed is a patch cord connector and connector block combination which results in low insertion forces and enhanced side-to-side stability for the patch cord connectors. The patch cord connector includes a latch member formed in a portion of one surface of the connector housing, and the connector block includes a series of grooves formed in its housing for receiving the latch.

9 Claims, 2 Drawing Sheets

CONNECTING BLOCK AND PATCH CORD COMBINATION

FIELD OF THE INVENTION

This invention relates to elements for providing electrical connection, such as those found in the 110-type connection system.

BACKGROUND OF THE INVENTION

The 110-type connection system is used throughout the telecommunications industry in order to electrically interconnect corresponding wires in two sets of wires. The first set is coupled to an index strip which includes a row of teeth so that each wire is secured between adjacent teeth. A connector block which includes contacts having insulation displacement portions on two opposite ends is brought down on the index strip to electrically contact the set of wires. The opposite ends of the contacts are enclosed by another set of teeth. Individual wires from the second set may be inserted into the insulation displacement portions between the teeth to make electrical contact with the first set of wires. Alternatively, the second set of wires may be electrically connected to a patch cord connector which includes conductive blades for insertion into the insulation displacement portions. (See, for example, U.S. Pat. No. 3,798,587 issued to Ellis, Jr. et al and U.S. Pat. No. 5,226,835 issued to Baker, et al.)

Typically, the connector block housing includes spherical bosses for providing an interference fit for retention of the patch cord. While adequate, such a mechanism involves high friction between the bosses and the patch cord connector which makes it difficult to insert and remove the patch cord. Removal is usually effected by a side-to-side rocking of the patch cord connector which can inadvertently remove adjacent patch cords since the side-to-side support of the patch cord connectors is generally weak. Further, the high friction can cause extensive wear of the surfaces so that the retention capability of the bosses degrades after multiple insertions and removals.

It is known to provide some type of latch on a patch cord connector. (See, for example, U.S. Pat. No. 4,203,066 issued to Buck.) However, it does not appear that the art has previously proposed a mechanism for improving side-to-side support of a patch cord connector inserted into a connector block.

SUMMARY OF THE INVENTION

The invention, in accordance with one aspect, is a connector block. The connector block comprises a row of contacts with insulation displacement portions on at least one end. The contacts are enclosed by an insulating housing which includes a row of teeth enclosing the insulation displacement portions of the contacts. A series of grooves is formed in the housing in an area removed from the teeth, the grooves being oriented in a direction which is essentially parallel to the orientation of the contacts. The grooves are positioned to receive respective portions of a cantilever latch, formed in a patch cord connector when mated with the connector block.

In accordance with another aspect, the invention is a patch cord connector which includes at least one contact blade connectable to a corresponding insulation displacement contact in a connector block. The connector includes an insulating housing having two opposing surfaces enclosing the blade. A cantilever latch member is formed in only a portion of one of said surfaces, the latch member adapted to engage at least one groove in the connector block when the blade is connected to the insulation displacement contact.

BRIEF DESCRIPTION OF THE FIGURES

These and other features of the invention are delineated in detail in the following description. In the drawing.

It will be appreciated that, for purposes of illustration, these figures are not necessarily drawn to scale.

DETAILED DESCRIPTION

Figure 1:
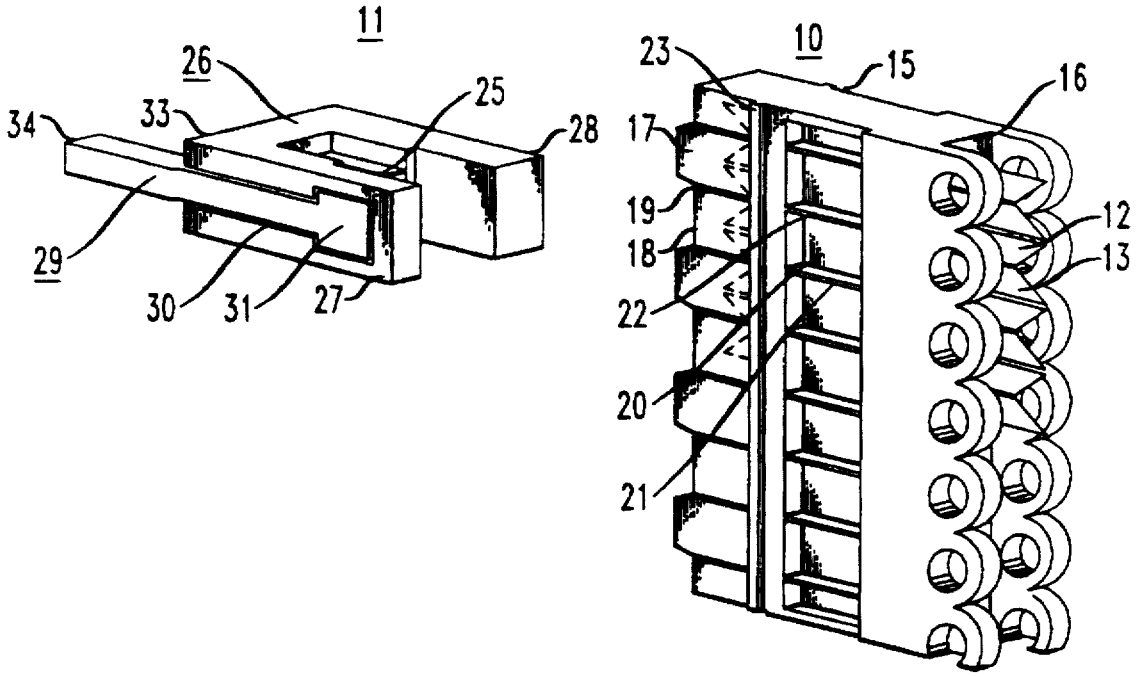
FIG. 1 is a perspective view of a connector block and the front end of a patch cord connector combination in accordance with an embodiment of the invention.
Figure 3:
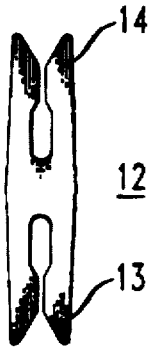
FIG. 3 is a front view of a portion of the connector block illustrated in FIG. 1.

Referring now to the drawings, in which like reference numerals identify similar or identical elements, FIG. 1 illustrates a connector block, 10, and patch cord connector, 11, in accordance with an embodiment of the invention. The connector block, 10, is a 110-type block which includes a row of contacts, e.g., 12. While four contacts are shown in this example, any number of contacts could be employed. As known in the art, each contact, 12, has insulation displacement portions, e.g., 13 and 14 of FIG. 3, on opposite ends, only one end, 13, being visible in the view of FIG. 1. The portions, e.g., 13, on the end illustrated in FIG. 1 are designed to make electrical contact with a set of wires (not shown) which are mounted in an alignment strip (not shown) by piercing the insulation surrounding the wires. The opposite ends, e.g., 14 of FIG. 3, are designed to receive respective conductive blades, e.g., 25, mounted in the patch cord connector, 11. Again, although only a single blade is visible, the patch cord connector usually includes at least two blades and can include any number of blades for electrical connection with corresponding contacts of the connector block.

The row of contacts, e.g., 12, in the connector block is enclosed by an insulating housing, 15, which is typically made of plastic. The housing, 15, includes a single aperture, 16, on one end to allow insulation displacement portions, e.g., 13, of the contacts to protrude and contact the set of wires on the alignment strip. The opposite end of the housing is formed into a row of teeth, e.g., 17 and 18, which enclose the opposite ends of the contacts. Between each adjacent pair of teeth, e.g., 17 and 18, is a slit, 19, which permits entry of the corresponding conductive blade, 25, of the patch cord connector, 11, so that the blade makes electrical contact with the insulation displacement portion, 14 of FIG. 3, at that end of the contact, 12.

The major surfaces of the housing, 15, at portions removed from the teeth, 17 and 18, include a row of grooves, e.g., 20, each groove being separated by a rib, e.g., 21 and 22. The grooves and ribs run in a direction which is essentially parallel to the direction of the contacts, e.g., 12, and are separated from the teeth, 17 and 18, by a ledge, 23. Each groove, e.g., 20, is also aligned with a corresponding tooth, e.g., 18.

Figure 2:
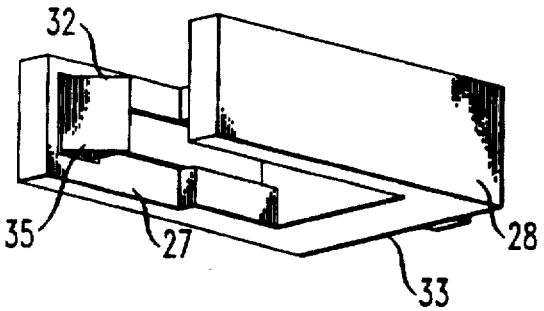
FIG. 2 is a different perspective view of the front end of the patch cord connector illustrated in FIG. 1.

As illustrated in FIGS. 1 and 2, the patch cord connector, 11, includes an insulating housing, 26, within which is mounted the blades, e.g., 25. The housing, 26, includes two opposite ends, 27 and 28, which extend beyond the blades, e.g., 25 (typically by an amount of approx. 5 cm). A cantilever latch member, 29, is formed in a cut-out portion, 30, of one of the ends, 27. The latch member, 29, includes at one end an essentially square latch head, 31, positioned in the portion of the end, 27, which extends beyond the blade, 25, and a handle, 34, at the opposite end. The hook, 32, of the latch head protrudes from the inner surface of the end, 27, toward the opposite inner surface of the end, 28. The latch member, 29, pivots about a portion of the back surface, 33, of the housing, 26.

In operation, the patch cord connector, 11, is mated with the connector block, 10, by pushing the connector over the block and positioning the connector, so that the ends, 27 and 28, cover and extend beyond the row of teeth, 17 and 18. At the same time, the blades, e.g., 25, are inserted into the appropriate slit, 19, to make physical and electrical contact with an end portion, 14, of a corresponding contact, 12. The hook, 32, includes a ramped surface, 35, which rides over the ledge 23. Thus, after the blades are inserted, the hook 32, of the latch member, 29, will be positioned within a corresponding groove, 20, so that accidental removal of the patch cord connector, 11, is prevented by the mechanical contact of the hook 32, with the ledge, 23. Further, side-to-side stability is enhanced to prevent rotation of the patch cord connector by the mechanical contact of the sides of the hook, 32, with the sides of the ribs, 21 and 22, adjacent to the groove. The fact that the latch member, 29, is formed into only a portion of the end, 27, of the patch cord connector is also advantageous because it eliminates the need for additional piece parts.

When it is desired to remove the patch cord connector, 11, from the connector block, 10, the handle, 34, is depressed removing the hook 32, from its groove, and the patch cord connector is pulled off without the need for rocking it from side to side.

It will be appreciated, therefore, that the patch cord connector exhibits a low insertion force and retention force when the handle of the latch member is depressed. Accidental removal, as by hitting the side of the patch cord connector when removing an adjacent connector, is minimized as long as the latch is engaged. Further, since the grooves, e.g., 20, ribs, e.g., 21 and 22, and ledge, 23, are in an area removed from the row of teeth, e.g., 17 and 18, the connector block, 10, is backward compatible with existing patch cord connectors.

Figure 4:
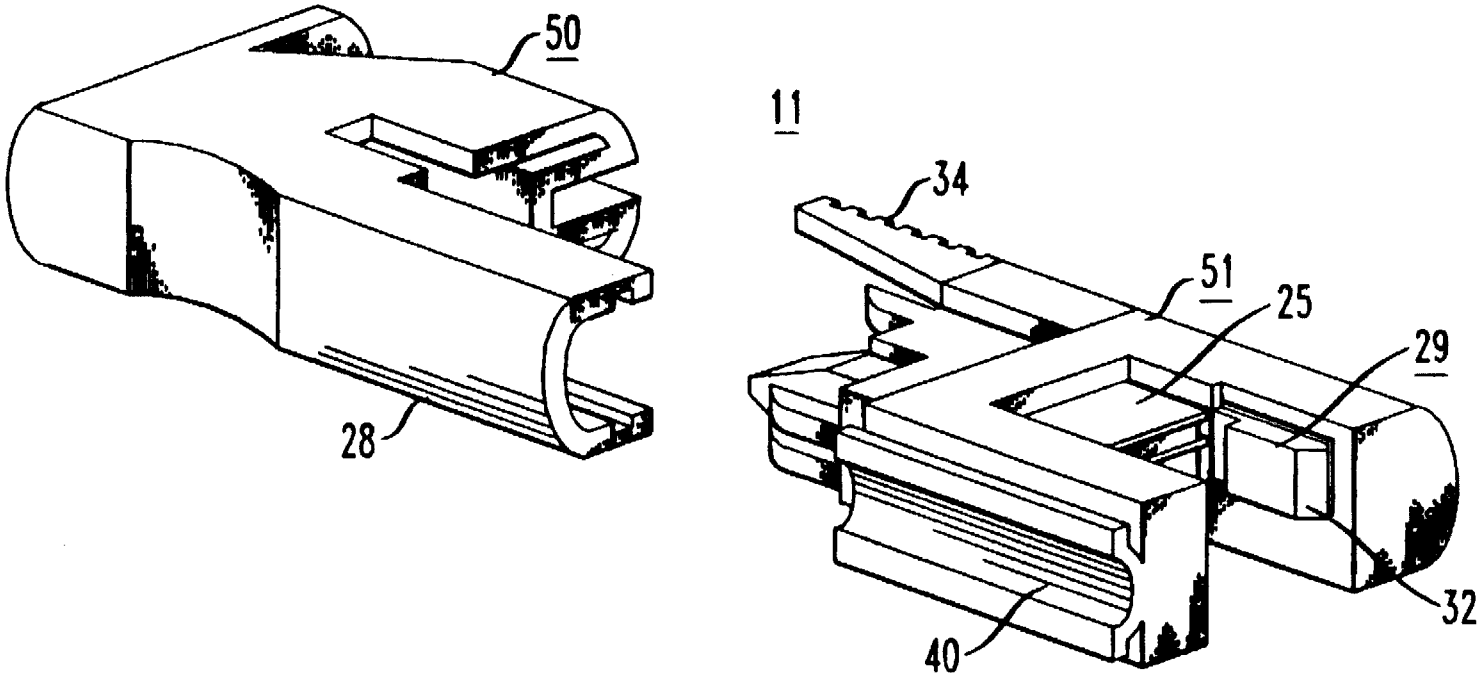
FIG. 4 is a perspective view of a patch cord connector in accordance with a further embodiment.

FIG. 4 illustrates another implementation of the principles described above for a patch cord connector, 11. It will be noted in this embodiment that the housing, 26, comprises two molded parts, 50 and 51, which are snapped together to form the final connector. Further, the end, 28, which does not include the latch member, 29, has a cylindrical opening, 40, for housing the patch cord (not shown) which is directed toward the front of the patch cord connector as shown in U.S. Patent Application of Conorich, filed on an even date herewith and incorporated by reference herein.

Various modifications will become apparent to those skilled in the art. For example, in cases where the patch cord connector 11, has several pairs of blades, a single latch, 29 can be fabricated with several hooks, 32, each aligned with a separate groove, 20, in the block. Alternatively, several latches can be make with a single handle, 34.

What is claimed is:

1. A connector block comprising:

a row of contacts with insulation displacement portions on at least one end;

an insulating housing enclosing the contacts, the housing including a row of teeth enclosing the insulation displacement portions of the contacts; and a series of grooves formed in the housing in an area removed from the teeth, the grooves being oriented in a direction which is essentially parallel to the orientation of the contacts, the grooves being positioned to receive respective portions of a cantilever latch formed in a patch cord connector when the patch cord connector is mated with the connector block.

2. A connector block according to claim 1 wherein the housing further includes a ledge separating the teeth from the grooves.

3. A connector block according to claim 1 wherein the housing further includes ribs in spaces between adjacent grooves.

4. A connector block according to claim 1 wherein the connector block is adapted for electrical connection in a 110-type system.

5. A connector block according to claim 1 utilized in combination with a patch cord connector which is adapted to be matingly connectable with the connector block to form a connector block, patch cord connector combination.

6. The combination of claim 5 wherein the patch cord connector further comprises:

at least one contact blade connectable to a corresponding insulation displacement contact in the connector block;

an insulating housing having two opposing ends enclosing the blade; and a cantilever latch member formed in only a portion of one of said ends, the latch member adapted to engage at least one groove in the connector block when the blade is connected to the insulation displacement contact.

7. The combination of claim 6 wherein the ends of the patch cord connector extend beyond the blade, and the latch member includes a head which is positioned in a portion of the end which extends beyond the blade.

8. The combination of claim 6 wherein the latch member is formed within a cut-out portion of the end.

9. The combination of claim 6 wherein the latch member includes a handle for pivoting the latch member about a portion of the housing.

* * * * *